US006884063B2

(12) United States Patent
Wong

(10) Patent No.: US 6,884,063 B2
(45) Date of Patent: Apr. 26, 2005

(54) MULTIPLE-FLAME LIGHTER

(76) Inventor: Chi Lam Wong, 1617 S. Euclid Ave., San Gabriel, CA (US) 91776

( * ) Notice: Subject to any disclaimer, the term of this patent is extended or adjusted under 35 U.S.C. 154(b) by 0 days.

(21) Appl. No.: 10/444,806

(22) Filed: May 23, 2003

(65) Prior Publication Data

US 2004/0234913 A1 Nov. 25, 2004

(51) Int. Cl.[7] ..... F23Q 2/46; F23Q 2/167; F23Q 2/173; F23Q 3/00; F23Q 2/42

(52) U.S. Cl. ..... 431/255; 431/253; 431/344; 431/278; 431/285; 431/280; 431/281

(58) Field of Search ..... 431/255, 253, 431/344, 254, 278–285, 277

(56) References Cited

U.S. PATENT DOCUMENTS 2,433,707 A * 12/1947 Phillips ..... 431/230
3,816,056 A * 6/1974 Brown ..... 431/253
4,351,318 A * 9/1982 Ojima et al. ..... 126/208
4,458,667 A * 7/1984 Hsieh ..... 126/208
5,055,033 A * 10/1991 Lee ..... 431/255

FOREIGN PATENT DOCUMENTS

DE 297 11 547 * 10/1997
GB 1384782 * 2/1975
JP 07-167430 * 7/1995

* cited by examiner

*Primary Examiner*—Carl D. Price
(74) *Attorney, Agent, or Firm*—Raymond Y. Chan; David and Raymond

(57) ABSTRACT

A multiple-flame lighter, including: a lighter housing, a storage having an outlet valve, an inlet valve and a gas chamber for storing liquid fuel gas, a gas outlet control bar for controlling gas supply from said storage, and a windproof assembly connected to the gas pass of the storage, characterized in that it also includes: an electronic igniter, a flint igniter, an ignition controller, wherein between the sleeve and the windproof assembly there is provided with a flint igniter which is adjacent to the sleeve and a flame outlet which is connected to the gas pass of the storage. The single one lighter is simple in structure and may achieve powerful windproof effect and has advantages of long time service life, luminous application and less heat generation.

18 Claims, 5 Drawing Sheets

MULTIPLE-FLAME LIGHTER

FIELD OF THE INVENTION

The present invention relates to a lighter device, and in particular to a lighter using inflammable gas as fuel stored in liquidity.

BACKGROUND OF THE INVENTION

Currently, lighters on market include candle flame lighters and windproof lighters. The candle flame lighters generally adopt flint ignition device as sparkling source and they are simple in structure and have relatively long time of use, and furthermore it may function as a lighting device in dark places, with the disadvantages in that they are not readily used in open air or windy places. Those windproof lighters chiefly use electronic ignition device as sparking source and have some windproof function. Nevertheless, such windproof lighters, limited by the times of use, have shorter service lives. In addition, when is use, they consume much more gas to produce the same height of flames as that of the candle flame lighters, and may easily create heat in their bodies when torch flame is generated, which limits the time of lighting up articles. Furthermore, their windproof ability is still limited as their flames are weak and may not easily light up articles, particularly cigars, in open air or windy places.

SUMMARY OF THE INVENTION

One objective of the present invention is to provide a multiple-flame lighter which has both flint ignition device and electronic ignition device, combines the advantages of the two meeting the requirement of windproof and long service life, and, as a result, greatly prolongs its service life.

Another objective of the present invention is to provide a multiple-flame lighter which is simple in structure and easy in operation of ignition and may conveniently shift between the flint and electronic ignition modes. As its structure is rationally designed, it need not enlarge the overall size of the lighter, and may only require one finger to sequentially operate in one direction to shift the modes between the flint ignition and the electronic ignition or to use both.

Further another objective of the present invention is to provide a windproof lighter having a windproof assembly including a quick flow nozzle and second outlet valve or gas diverting pass, which may produce one or more straightforward and rod-shaped torches or big-head-shaped flames, achieving better windproof results.

The objectives of the present invention are achieved in such a way that: it includes a lighter housing, a storage having an outlet valve, an inlet valve and a gas chamber for storing liquid fuel gas, a gas outlet bar for controlling gas supply from the storage, and a windproof assembly connected to the gas pass of the storage, characterized in that is also includes: an electronic igniter, a flint igniter, an ignition controller formed by flame outlet and a sleeve, wherein the sleeve is provided on the upper portion of one side of the lighter housing, the electronic igniter is provided under the sleeve, and the flint igniter and flame outlet are provided under the sleeve, and the flint igniter and flame outlet are provided between the sleeve and the windproof assembly. The flint igniter device is provided on the side close to the sleeve, and the flame outlet connected to the gas pass of the storage.

Further, the flint igniter comprises an ignition wheel, a flint and a spring means, wherein the ignition wheel is provided above the sleeve and along the same operation line/route as that of the sleeve and the electronic igniter.

The windproof assembly includes a filter means, a quick flow nozzle, a gas mixing chamber, a diverting nozzle and a combustion chamber. The diameter of the pores of the quick flow nozzle is within the range of 0.05 mm~0.18 mm.

The sleeve has a front end and the gas outlet control bar has one end fit in with the tip portion of the front end and the other end connected to the gas outlet valve of the storage. The gas outlet control bas has one slide block which moves to press a soft pipe provided within the flame outlet, making the flame outlet open or close. In addition, there is one supplementary spring provided on the side of the soft pipe, effecting a buffer function.

The flame outlet also includes a gas limiting structure.

Furthermore, there is a gas diverting pass provided between the flame outlet and the outlet valve of the storage, making flame outlet connected to the gas diverting pass. Between the gas diverting pass and the flame outlet there is a cover means. And the gas diverting pass has one seal means provided on the outlet port, a hole on the side wall and a seal ring for sealing with the cover means provided under the hole.

The storage also includes a second outlet valve and the flame outlet is connected to the second outlet valve.

The multiple-flame lighter according to the present invention has better windproof effects, achieves additional luminous function and longer service life and may not easily create heat, combining advantages of both candle flame lighters and windproof lighters and achieving a notable progress compared with prior art. In addition, the present invention is structurally simple and easily operable as it flexibly combines both the flint and electronic igniters by arranging a flint wheel, a sleeve and an electronic igniter on the same operational line/route, achieving better effect of easy shifting between the two ignition modes. Meanwhile, such structure may not necessarily increase the size of the lighter making it more flexible in its outer design for use in various environments. And the present invention may also produce as the same time two flames—windproof torch and candle flame—solving the ignition difficulty that occur in case of strong wind or long time use, such as lighting up a cigar.

BRIEF DESCRIPTION OF THE DRAWINGS

Next, further description will be made to the present invention by reference to the following drawings wherein.

Figure 1:
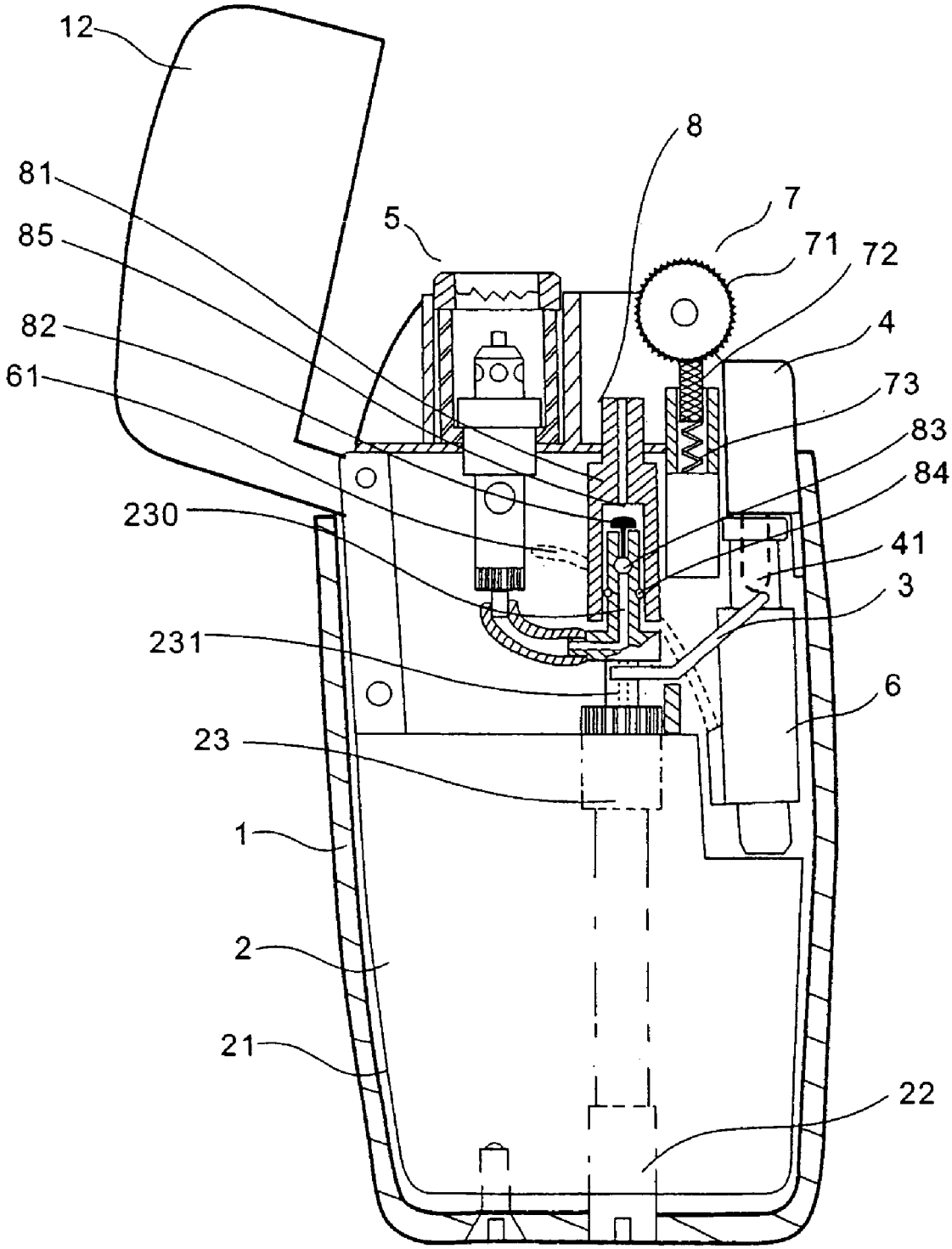
FIG. 1 is a sectional view showing the structure of the first embodiment of the present invention.

Wherein:

1—lighter housing; 12—head cover; 2—storage; 21—gas chamber; 22—inlet valve; 22'—second inlet valve; 23—outlet valve; 231, 231'—valve core; 23'—second valve; 230—gas diverting pass; 3—outlet control bar; 3'—second control bar; 4—sleeve; 41—front end of the sleeve;

5—windproof assembly; 51—filter means; 52—quick flow nozzle; 53—gas mixing chamber; 54—diverting combustion chamber; 56—windproof mesh; 6—electronic igniter; 61—wire; 7—flint igniter; 71—ignition wheel; 72—flint; 73—spring means; 8—flame outlet; 80—soft pipe; 81—cover means; 82—seal means; 83—hole; 84—seal ring; 85—inlet port; 86—supplementary spring; 87—gas flow limiting structure; 9—slide block.

DETAILED DESCRIPTION OF THE INVENTION

Refer to the drawings: the multiple-flame lighter according to the present invention, including a lighter housing 1, a gas chamber 21 for holding flammable liquid gas and a storage 2 including an outlet valve 23 and an inlet valve 22, an outlet control bar 3 for controlling the storage, a windproof assembly 5 connected to the gas pass of the storage, and an ignition control means composed of an electronic igniter 6, a flint igniter 7, a flame outlet 8 and a sleeve 4. The sleeve 4 is provided at the upper portion of one side of the lighter housing 1, the electronic igniter 6 is arranged under the sleeve 4, the flint igniter 6 and the flame outlet 8 are provided between the sleeve 4 and the windproof assembly 5, wherein the flint igniter 6 is arranged close to the sleeve 4, and the flame outlet 8 is connected to the gas pass of the storage 2.

An outlet control bar 3 is provided on the outlet valve 23 for controlling valve core 231 of the outlet valve 23 and may be controlled by the head cover 12 of the lighter housing 1 and/or sleeve 4. When the valve core 231 is actuated gas chamber 21 releases fuel gas which flows quickly into the filter means 51 of the windproof assembly 5, becoming a quick flow through the pores of the quick flow nozzle 52 to turn into a powerful and specially flammable mixed gas after being mixed with the air in the gas mixing chamber 53 and further diverted in the diverting nozzle 54. Generally the diverting nozzle 54 may be various: e.g. four small holes may be drilled on the sides of the nozzle 54 turning the mixed gas into a big-head-shaped torch, or, a direct through hole may be drilled on the top of the nozzle 54 and several small holes are arranged on the side of the direct through hole making the mixed gas become a powerful, bar-shaped torch, or further, two or more than two through holes are installed on the top of the nozzle 54 and some smaller holes are arranged around the through holes making the mixed gas turn into several powerful, bar-shaped torches so as to enlarge the burning area.

Additionally a windproof mesh 56 (see FIG. 3) may be provided within the combustion chamber 55 to enhance the windproof ability of the flame.

When there is a need for long time use of a candle flame, the candle flame igniter may be used to avoid easy heat accumulation. The fuel gas in the storage 2 may then be released via the flame outlet 8 and ignited by the flint igniter 6, turning into a candle flame.

PREFERRED EMBODIMENT OF THE INVENTION

Refer to FIG. 1, a flint igniter 7 and a flame outlet 8 are installed between the sleeve 4 and the windproof assembly 5, the flame outlet 8 is connected to the gas pass of the storage 2. The sleeve 4 has a front end 41 which has it end portion fit with one end of the outlet control bar 3 which has its other end connected to the outlet valve 23 of the storage 2. When the sleeve 4 is pressed down or released, the front end 41 moves up and down controlling the movement of the outlet control bar 3 which further actuates the open or close of the outlet valve 23 connected to the outlet control bar 3.

The flint igniter 7 includes an ignition wheel 71 having coarse periphery, a flint 72 which may produce sparks after friction with the ignition wheel 71, and a spring means 73 which presses a sparking end of the flint 72 onto the coarse surface of the ignition wheel 73. Preferably the wheel 71 is installed close to the upper portion of the sleeve 4, and the wheel 71, the sleeve 4 and the electronic igniter 6 are arranged on the same operational route. When the wheel 71 is turned by a user's finger, the flint 72 has its sparking end generate dispersed sparks, and along with downward movement of the finger, the front end 41 of the sleeve 4 moves down one end of outlet control bar 3, enabling the other end of the bar 3 slightly to raise up the valve core 231 of the outlet valve 23 to release out the fuel gas of the storage 2 through the flame outlet 8 and turning it into a candle flame when ignited by flint's sparks.

A gas diverting pass 230 is provided between the flame outlet 8 and the storage 2, and connected to the flame outlet 8 and the gas pass of the storage 2. Generally, in case there are several passes, fuel gas would tend to flow towards the pass having a bigger diameter. The quick flow nozzle 52 (see FIG. 2) of the windproof assembly 5 according to the present invention has its pores' diameters as small as 0.05~0.18 mm, and consequently when the fuel gas is diverted, most part of the gas would flow towards the flame outlet 8. To conveniently shift the ignition modes, between the gas diverting pass 230 and flame outlet 8 there may be provided with a cover means 81 which may be formed with flame outlet 8 as one body, a seal means 82 may be provided at outlet port of the gas diverting pass 230, hole 83 may be made on the side of the gas diverting pass 230, and a seal means 84 may be provided under the hole 83 of the gas diverting pass 230 for sealing with respect to the cover means 83. When the sleeve 4 is pressed down, the front end 41 thereof makes one end of the outlet control bar 3 move downward and the other end lift up the valve core 231 of the outlet valve 23 to make T-shaped seal means 82 provided at outlet port of the gas diverting pass 230 on the valve core 231 block out the inlet port 85 of the cover means 81, i.e. the pass of the candle flame outlet 8. Meanwhile the seal ring 84 provided between the gas diverting pass 230 and the cover means 81 also blocks the leakage of the fuel gas, thus forcing the fuel gas in the gas diverting pass 230 to flow back to the windproof assembly 5. When the sleeve 4 is released, T-shaped seal means 82 moves away form the inlet port 85 of the cover means 81, making majority of the fuel gas released from the outlet valve 23 flow out from the candle flame outlet 8.

When there is a need for windproof torch in the open or windy places, the sleeve 4 is pressed down, its front end 41 then makes one end of the outlet control bar 3 move downwards, while the other end of the outlet control bar 3 raises up the valve core 231 of the outlet valve 23, enabling the T-shaped cover means 82 at the outlet port of the gas diverting pass 230 cover up the inlet port 85 of the cover means 81 and directing the fuel gas to quickly enter the windproof assembly 5. At this time, the electronic igniter 6 provided under the sleeve 4 is actuated to generate sparks in virtue of wire 61 which transfers the electronic sparks to the combustion chamber 55, thus making the gas in the combustion chamber ignited and turned into a powerful windproof torch. And if a long time flame is needed, e.g. when it is used within a room or for luminescence, the candle flame structure with relatively lower consumption of gas may by adopted.

Thus one lighter has achieved both powerful windproof and luminous effects, in addition to advantages of long service life and resistance to heat accumulation.

Figure 2:
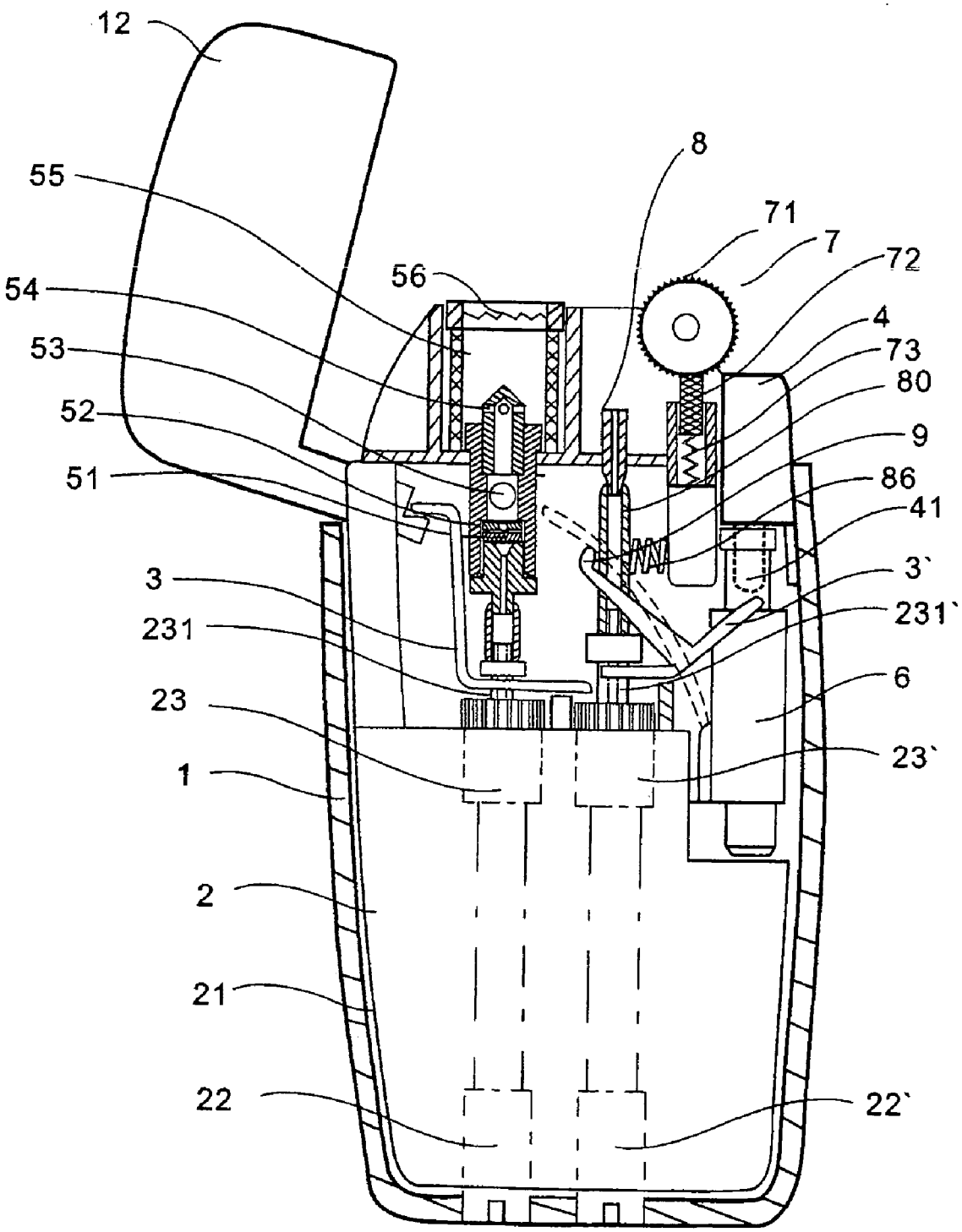
FIG. 2 is a sectional view showing the structure of the second embodiment of the present invention.

Refer to FIG. 2, in order to bring the height of flame generated by the flint igniter 7 to better control, a second outlet valve 23' connecting to the candle flame outlet 8 may also be additionally installed within the storage 2 to replace the gas diverting pass as shown in FIG. 1. In such case, gas release may be achieved by opening the head cover 12 of the housing 1 which further actuates the outlet control bar 3 connected to the valve core 231 of the outlet valve 3. In the present embodiment, the central part of the flame outlet 8 may be a soft pipe 80 made of soft materials, and a slide block 9 which may open or close the flame outlet may be installed on the outlet control bar 3.

When there is a need for windproof torch, an adjustment valve (not shown) in the outlet valve 23 is opened before opening up the cover means 12 to enable the outlet valve 23 to release fuel gas to flow into the combustion chamber 55 of the windproof assembly 5, and then the sleeve 4 is pressed down to raise up the valve core 231' of the outlet valve 23' through the outlet control bar 3', and, at the same time when the gas is released from the storage 2, the slide block 9 presses the soft pipe 80, preventing the gas from flowing to the flam outlet 8. At this time, along with the downward movement of the sleeve 4, the electronic igniter 6 generates in the windproof assembly 5 electronic sparks which ignites the fuel gas in the combustion chamber 55 and turns it into a powerful windproof flame. And when there is a need for candle flame, the adjustment valve (not shown) shall be closed, and the wheel 71 is turned making the flint 72 produce dispersed sparks at its sparking end, and at the same time, the sleeve 4 is slightly pressed down causing the outlet valve 23' to release fuel gas through the gas outlet 8 whose soft pipe 80 is then not blocked by the slide block 9 and turn the fuel gas into candle flame with the sparks generated by the flint 72.

On the side of the soft pipe 80 there is provided with a supplementary spring 86, which may prevent the slide block 9 from breaking the soft pipe 80 and effect some buffer function.

Figure 3:
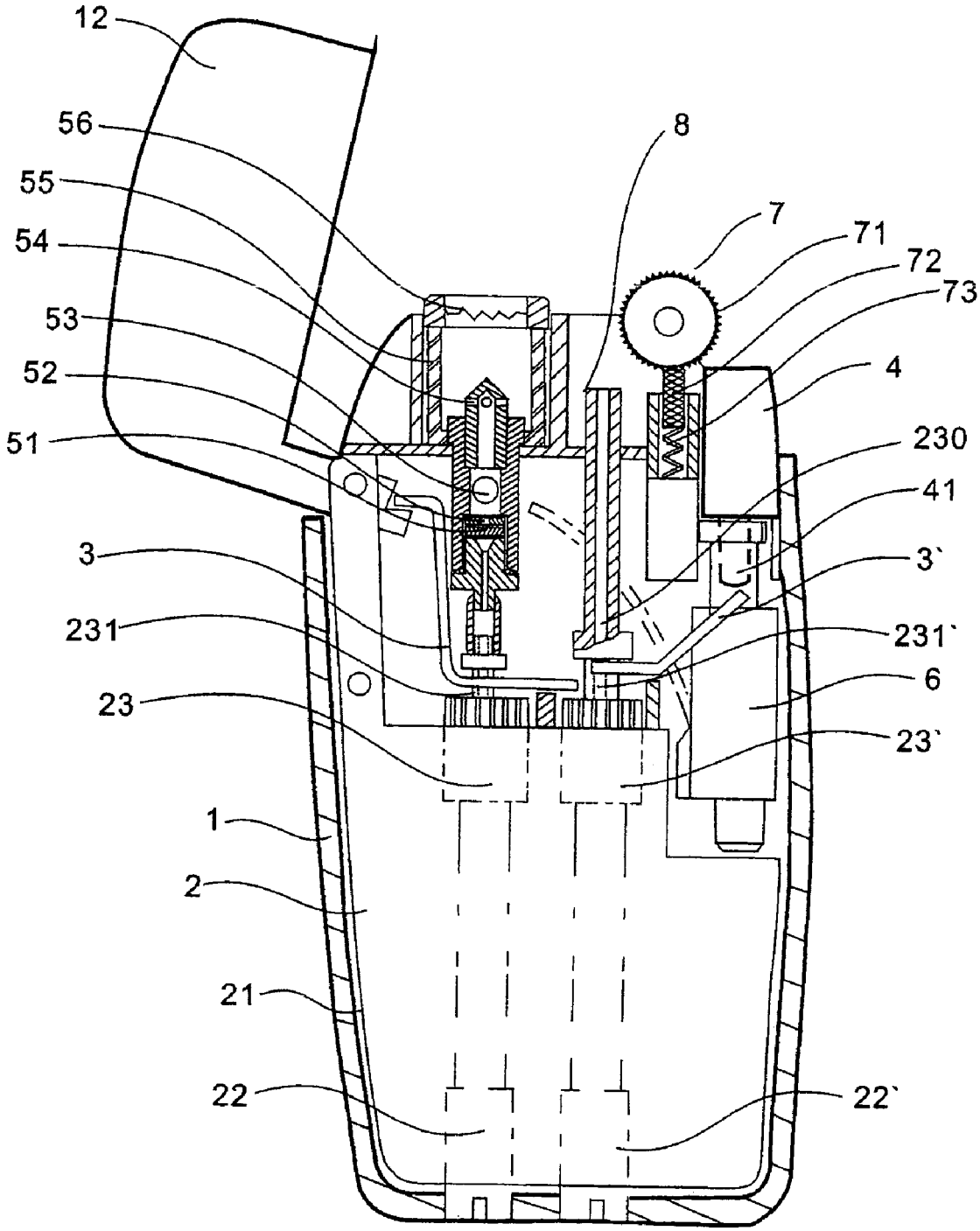
FIG. 3 is a sectional view showing the structure of the third embodiment of the present invention.

Refer to FIG. 3, the difference between this embodiment and that as shown in FIG. 2, is the omission of the slide block 9 which is mounted at the outlet control bar 23', functioning to block and open the gas outlet 8. When there is a need for candle flame, the adjustment valve (not shown) of the outlet valve 23 is closed at the time when the adjustment valve (not shown) of the outlet valve 23' is opened, and as the user's finger turns the wheel 71, the flint 72 gives out sparks, and at the time when the finger continues to move downwards, the sleeve 4 there under moves correspondingly to make the gas as released by the outlet valve 23' from the candle flame outlet 8 come out be ignited by the sparks as made by the flint 72 and turned to candle flame. When there is a need for windproof torch, the adjustment valve (not shown) of the outlet valve 23' is closed while the adjustment valve (not shown) of the outlet valve 23 opened, and as the head cover 12 is opened, the outlet valve 23 releases out fuel gas. Along with the movement of the user's finger downwards pressing the sleeve 4, the electronic igniter 6 under the sleeve 4 is actuated to emit sparks to the windproof assembly 5, consequently generating the windproof torch flame with the gas in the windproof assembly 5. Alternatively, both the adjustment valves (not shown) of the outlet valves 23 an 23' may be opened, and when the head cover 12 is opened releasing gas from the outlet 23, user's finger moves down to turn the wheel 71 making the flint 71 give out sparks which further ignite the gas released from the flame outlet 8 generating candle flame, and along with the downwards movement of the finger, the electronic igniter 6 actuates to ignite the fuel gas in the combustion chamber 55 of the windproof assembly 5, generating windproof torch flame. In the circumstances, the objectives of generating both candle flame and windproof torch flame within one lighter have been achieved and the disadvantages such as uncertainty to locate the windproof lighter in the dim places have been removed, creating enjoyable elegance and grace in lighting up articles with both flames.

Figure 4:
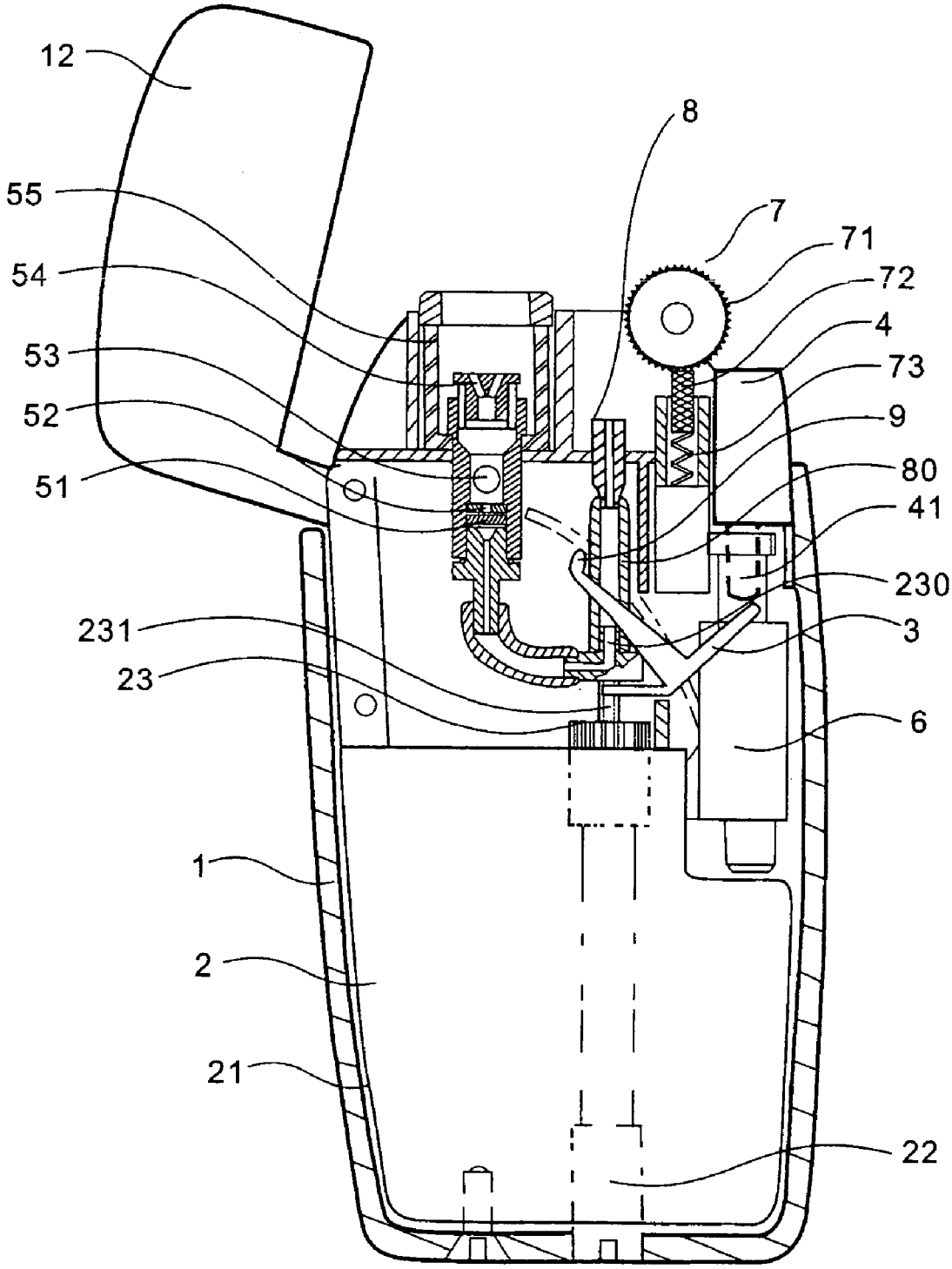
FIG. 4 is a sectional view showing the structure of the fourth embodiment of the present invention.

Refer to FIG. 4, the embodiment is different from that as shown in FIG. 2 in that in FIG. 4 the fuel gas in the flame outlet 8 is obtained from a gas diverting pass 230 on the outlet valve 23, while the fuel gas in the flame outlet 8 according to FIG. 2 is obtained from two outlet valves of the outlet valves 23 and 23'.

Figure 5:
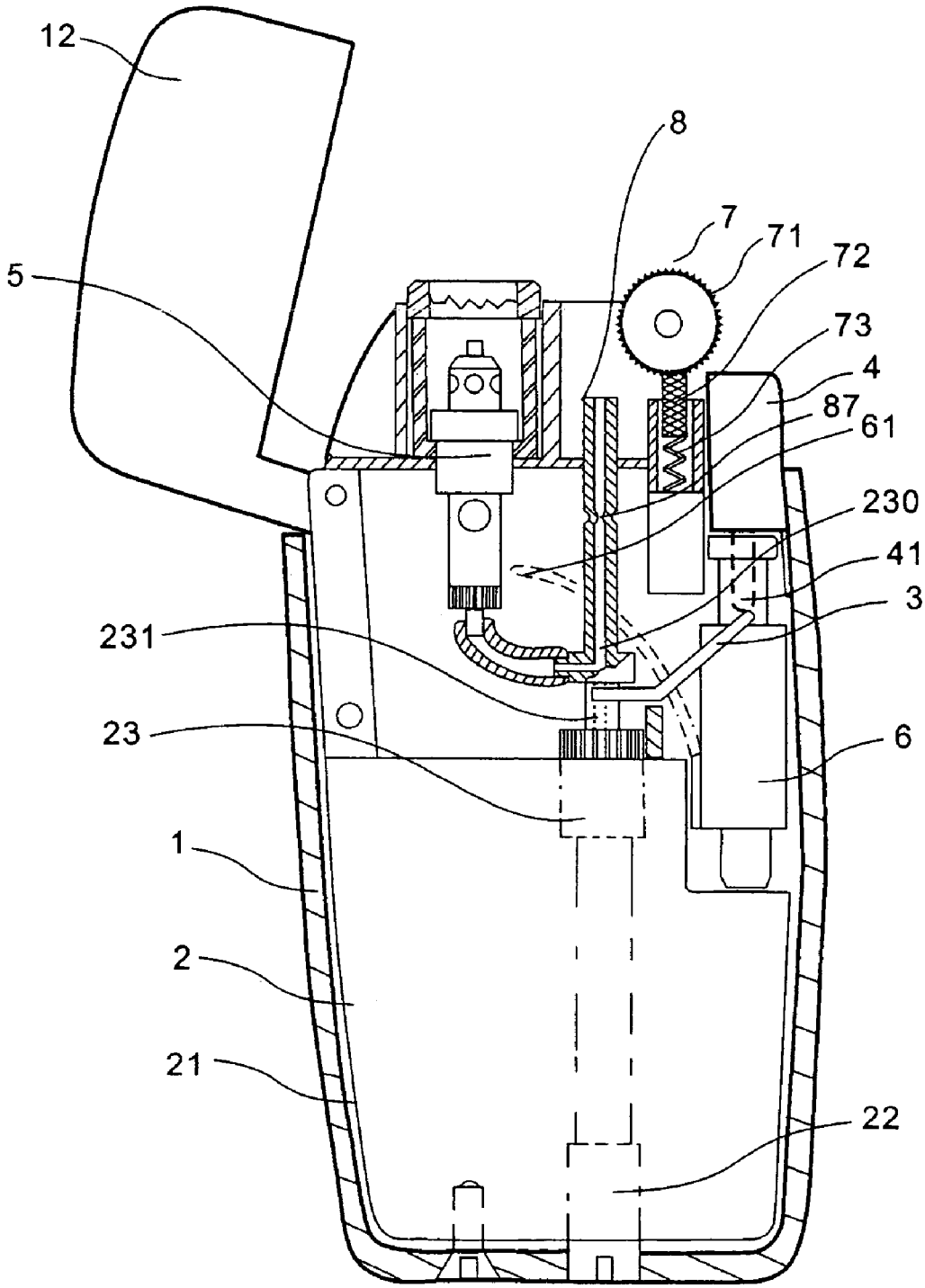
FIG. 5 is a sectional view showing the structure of the fifth embodiment of the present invention.

Refer to FIG. 5, the gas limiting structure 87 provided in the flame outlet 8, functioning to rationally distribute the gas, is simply structured by narrowing the central segment of the flame outlet 8. Alternatively, the limiting structure 7 may also be formed by a spongy materials provided in the flame outlet 8, or the spongy materials may also be replaced by pores as in the quick flow nozzle 52 in the flame outlet 8. Thus when the user's finger operates along one operational line or route actuating in series the wheel 71, the sleeve 4 and the electronic igniter 6, both powerful windproof torch flame and candle flame can be obtained with a single one lighter.

Though the detailed description by reference to the drawings and embodiments is made above, it is apparently clear to those skilled in the are that the above embodiments are not limitation thereto but only for description of the present invention. Within the spirit of the present invention, there may be modifications and variations to the above embodiments which fall within the scope of present invention.

What is claimed is:

1. A multiple-flame lighter, comprising:

a lighter housing, a storage having an outlet valve, an inlet valve and a gas chamber for storing liquid fuel gas, means for controlling gas supply from said storage, and a windproof assembly connected to a gas pass of said storage, characterized in that said multiple-flame lighter includes:

an ignition controller which comprises a sleeve provided at an upper portion of a side of said lighter housing and a flame outlet connected to said gas pass of said storage, an electronic igniter provided in upper portion lighter housing and positioned under said sleeve to ignite gas emitted from said windproof assembly, and a flint igniter, which is provided on said side of said lighter housing and positioned adjacent to said sleeve while said flint igniter and said flame outlet are provided between said sleeve and said windproof assembly, for producing sparks towards said flame outlet for igniting gas emitted said flame outlet to form a flame.

2. A multiple flame lighter according to claim 1, characterized in that said flint igniter comprises an ignition wheel, a flint and a spring, wherein said ignition wheel is provided adjacent to said sleeve to enable a rotation of said ignition wheel and a pressing of said sleeve to actuate said electronic igniter in a continuous operation.

3. A multiple flame lighter according to claim 1, characterized in that said windproof assembly includes a filter, a quick flow nozzle, a gas mixing chamber, a diverting nozzle and a combustion chamber, wherein a diameter of pores of said quick flow nozzle is within a range of 0.05 mm~0.18 mm, wherein when said outlet valve is actuated, said gas chamber releases fuel gas which flows into said filter and forms a flow through said pores of said quick flow nozzle to turn into a powerful and flammable mixed gas after being mixed with air in said gas mixing chamber and further diverted in said diverting nozzle so as to turn said mixed gas into a torch in said combustion chamber.

4. A multiple flame lighter according to claim 1, characterized in that said means is a gas outlet control bar, wherein said sleeve has a front end and said gas outlet control bar has one end coupled with a tip portion of said front end while another end connected to said outlet valve of said storage.

5. A multiple flame lighter according to claim 4, characterized in that said flame outlet also includes a soft pipe and said gas outlet control bar has one slide block which moves to press said soft pipe to selectively open and close said flame outlet.

6. A multiple flame lighter according to claim 5, characterized in that one supplementary spring is provided on outer portion of said soft pipe, effecting buffer function.

7. A multiple flame lighter according to claim 1, characterized in that said flame outlet includes a gas limiting structure.

8. A multiple flame lighter according to claim 1, characterized in that a gas diverting pass is provided between said flame outlet and said outlet valve of said storage.

9. A multiple flame lighter according to claim 8, characterized in that a cover is provided between said gas diverting pass and said flame outlet, wherein said gas diverting pass has a seal provided on a outlet port thereof, a hole formed on a side wall thereof and a seal ring provided under said hole for sealing with said cover.

10. A multiple flame lighter according to claim 1 or 2 or 3 or 4 or 7, characterized in that said storage also includes a second valve connected to said flame outlet.

11. A multiple flame lighter according to claim 2, characterized in that a gas diverting pass is provided between said flame outlet and said outlet valve of said storage.

12. A multiple flame lighter according to claim 11, characterized in that a cover is provided between said gas diverting pass and said flame outlet, wherein said gas diverting pass has a seal provided on a outlet port thereof, a hole formed on a side wall thereof and a seal ring provided under said hole for sealing with said cover.

13. A multiple flame lighter according to claim 3, characterized in that a gas diverting pass is provided between said flame outlet and said outlet valve of said storage.

14. A multiple flame lighter according to claim 13, characterized in that a cover is provided between said gas diverting pass and said flame outlet, wherein said gas diverting pass has a seal provided on a outlet port thereof, a hole formed on a side wall thereof and a seal ring provided under said hole for sealing with said cover.

15. A multiple flame lighter according to claim 4, characterized in that a gas diverting pass is provided between said flame outlet and said outlet valve of said storage.

16. A multiple flame lighter according to claim 15, characterized in that a cover is provided between said gas diverting pass and said flame outlet, wherein said gas diverting pass has a seal provided on a outlet port thereof, a hole formed on a side wall thereof and a seal ring provided under said hole for sealing with said cover.

17. A multiple flame lighter according to claim 7, characterized in that a gas diverting pass is provided between said flame outlet and said outlet valve of said storage.

18. A multiple flame lighter according to claim 17, characterized in that a cover is provided between said gas diverting pass and said flame outlet, wherein said gas diverting pass has a seal provided on a outlet port thereof, a hole formed on a side wall thereof and a seal ring provided under said hole for sealing with said cover.

* * * * *